United States Patent [19]

Johnson

[11] 3,993,311

[45] Nov. 23, 1976

[54] COMPRESS ARROW

[76] Inventor: William Johnson, 5830 Elbow Lane, St. Cloud, Minn. 56301

[22] Filed: May 3, 1976

[21] Appl. No.: 682,531

[52] U.S. Cl. ..... 273/106.5 R; 273/106.5 B; 273/106.5 C

[51] Int. Cl.[2] ..... F41B 5/02

[58] Field of Search ..... 273/106.5 R, 106.5 B

[56] References Cited

UNITED STATES PATENTS

| | | | |
|---|---|---|---|
| 2,848,834 | 8/1958 | Cox | 273/106.5 R X |
| 3,393,912 | 7/1968 | De Lonais | 273/106.5 R |
| 3,417,994 | 12/1968 | Rohrbaugh, Jr. | 273/106.5 R |
| 3,457,921 | 7/1969 | Waldeisen | 273/106.5 R UX |
| 3,617,060 | 11/1971 | Iezzi | 273/106.5 R |
| 3,759,519 | 9/1973 | Palma | 273/106.5 R |

*Primary Examiner*—Paul E. Shapiro
*Attorney, Agent, or Firm*—Jones, Tullar & Cooper

[57] ABSTRACT

This invention relates to a hunting arrow that will cause massive bleeding in wounded game, thus hastening the death of the game and facilitating the tracking thereof. The arrow is comprised of hollow inner shaft, a hollow outer shaft which is slightly shorter than the inner shaft and which is slidably mounted thereon, a nock which is friction fitted in the outer shaft, an arrowhead which is mounted to the inner shaft and a short length of high strength line connected to the nock and to the arrowhead and disposed within the inner shaft. Upon impact with the game, the outer shaft will slide foward causing the rear end of the inner shaft to dislodge the nock from the outer shaft. The nock will fall to the ground and become entangled in the brush, thus pulling back on the arrowhead by means of the high strength line.

10 Claims, 5 Drawing Figures

FIG. 1
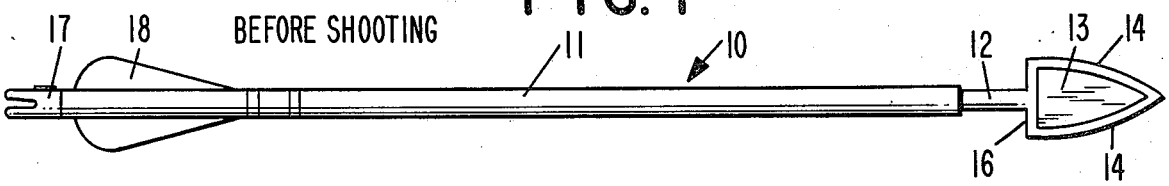
FIG. 2
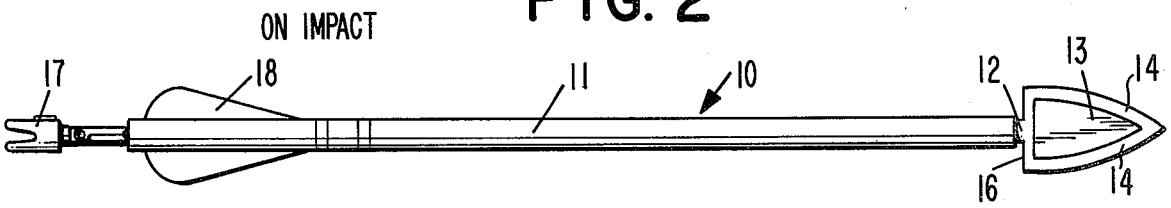
FIG. 3
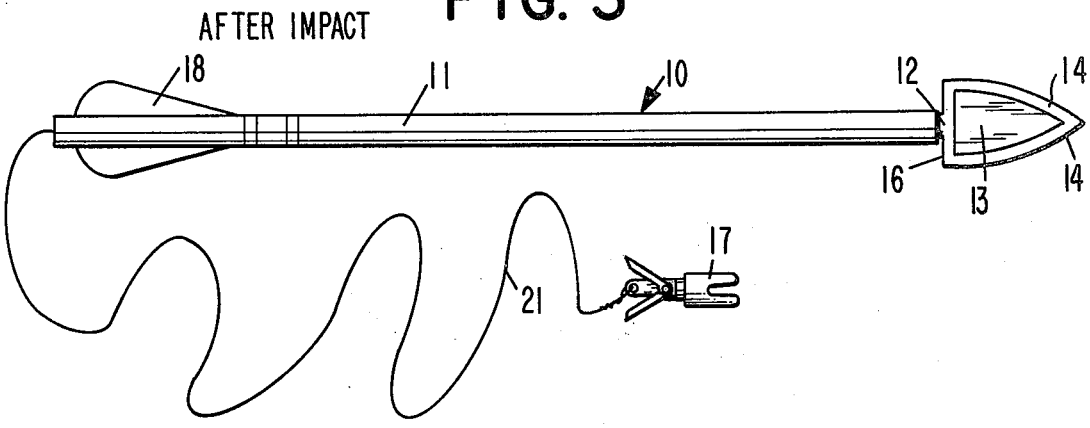
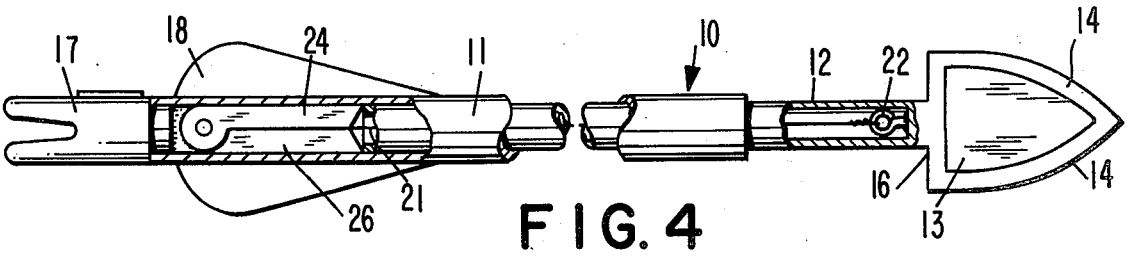
FIG. 4
FIG. 5
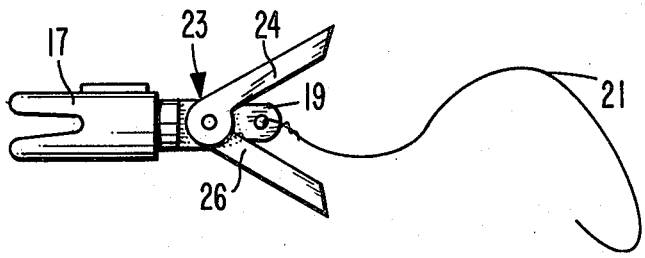

COMPRESS ARROW

SUMMARY OF THE INVENTION

This invention relates to a hunting arrow that will hasten the time required for wounded game to bleed to death and will facilitate tracking the game by following its blood trail.

When bow hunting game, such as deer, the hunter often encounters the problem of tracking the game after it has been struck with an arrow. Quite often, this problem arises because the blood trail left by the game is small or non-existent and the area may not be suitable for following game footprints. This problem is often compounded by the fact that wounded game often runs a great distance before it dies.

Many attempts have been made to overcome the problem of tracking wounded game. For example, it has been proposed in U.S. Pat. No. 3,066,940 to provide means in an arrowhead for injecting a tranquilizing fluid into the hunted animal's body to prevent the wounded animal from running off. Also, it has been proposed, in U.S. Pat. No. 3,417,994, to provide an arrow with an integral trailing means comprised of a bobbin having a continuous length of yarn, such that when the arrow is embedded in moving game, the yarn would unravel from the bobbin and leave a marking trail whereever the wounded game would carry the embedded arrow. In still another patent, U.S. Pat. No. 2,993,697, it has been proposed to provide fatal hemorrhaging of a wounded animal in a relatively short time by utilizing a broadhead arrowhead having pivotal cutting blades which pivot from a folded shooting position to an open cutting position upon contact with a target.

This invention solves the problem of having to locate and follow a blood trail that may be small or non-existent, even when the arrow causing the wound has passed completely through the game, by providing a hunting arrow that will cause massive bleeding. The arrow of this invention will cause a relatively rapid kill of the game and will enable the hunter to track the wounded game by following an easily detectable blood trail.

The arrow of this invention comprises a hollow inner shaft to which a broadhead arrowhead is fixedly attached. A hollow outer shaft, which is somewhat shorter than the inner shaft, is slidably mounted over the inner shaft and is provided with a nock at the rear end thereof. However, unlike a conventional arrow, the nock is detachably mounted to the outer shaft such that when the arrowhead impacts a target, the outer shaft slides along the inner shaft towards the arrowhead causing the relative rearward movement of the inner shaft to drive or "pop off" the nock from the outer shaft. A short length of high strength line, e.g., a 10 foot or so length of 100 pound test nylon line, is secured at one end thereof to the nock and at the other end to the arrowhead. The line is disposed or stored within the inner shaft until the nock is "popped off." In a preferred embodiment, an anchor means, such as a spring loaded V-shaped anchor is mounted to the nock so as to open when the nock "pops off" the outer shaft.

Thus, upon impact, regardless of whether or not the arrow ultimately passes through the game, the outer shaft will slide forwardly over the inner shaft causing the rear end of the inner shaft to "pop off" the nock. The nock, preferably with an attached anchor means triggered into an open or anchoring position, will then fall to the ground carrying one end of the high strength line with it. The nock will then become tangled in the brush, a tree, or the like as the wounded game runs from the location where it was struck with the arrow, causing the high strength line to become taut. If the arrowhead has passed completely through the game, the taut line will ultimately cause the arrowhead to be pulled back completely through the game. Similarly, if the arrowhead merely is embedded in the game, the taut line will cause the arrowhead to be pulled back out of the game. In either event, since the arrowhead normally would be razor sharp at both the leading or side edges thereof and at its base or rearward edges, the double-acting forward and rearward cutting caused by the initial impact and the pulling back of the arrowhead by the taut line will cause severe hemorrhaging, rapid kill, and an easily trackable blood trail.

Hence, it is an object of this invention to provide a hunting arrow which will permit a rapid kill of wounded game.

Another object is to provide a hunting arrow that will cause severe bleeding, thereby facilitating the tracking of a wounded animal's blood trail.

It is yet another object to provide means for pulling an arrowhead from wounded game. Still another object is to provide anchoring means for initiating the pulling of an arrowhead from wounded game.

These and other objects will become more fully apparent from a study of the following specification and claims, taken in conjunction with the drawing in which:

FIG. 1 is a side elevational view of an arrow embodying the principles of the present invention, viewed prior to shooting;

FIG. 2 is a side elevational view of the arrow of FIG. 1 viewed immediately after impact;

FIG. 3 is a side elevational view of the arrow of FIG. 1, viewed shortly after impact;

FIG. 4 is a cross-sectional view of a portion of the arrow of FIG. 1, illustrating a high test line attached to the arrowhead and nock thereof; and FIG. 5 is a side elevational view of the nock having a spring loaded anchor means in an open or anchoring position.

Referring now to the drawing, 10 represents a hunting arrow having a hollow outer shaft 11, a hollow inner shaft 12 slidably fitted within the outer shaft 11, and a broadhead point or arrowhead 13 having side and rear cutting edges 14 and 16, respectively. The arrowhead 13 is positioned at the forward end of the inner shaft 12. The arrow 10 also comprises a nock 17 positioned at the rearward end of the outer shaft 11, and fletching vanes or flight guiding feathers 18 extending radially outwardly from the lateral rearward end of the outer shaft 11.

The hollow outer shaft 11 may be any of those conveniently available made of, for example, aluminum, Fiberglass, or the like. The inner shaft 12 would also comprise aluminum or the like material, but would be of slightly smaller diameter than the outer shaft 11. In practice, it is desirable that a slight positive force be required to slide the outer shaft over the inner shaft. For example, if the arrow 10 were to be held by the arrowhead 13 in a vertical position, the frictional forces exerted between the contacting surfaces of the inner and outer shafts should be sufficient to prevent the outer shaft from sliding over the inner shaft under the influence of gravity. However, the frictional forces should be small enough so that they are easily overcome when the arrowhead 13 impacts a target.

The nock 17, which is generally made of a metal or plastic material, is inserted within the rearward opening of the outer shaft 11, where it is held in place merely by friction. As shown most clearly in FIGS. 4 and 5, the nock is provided with attachment means, such as eyelet means 19 or some other suitable means, to which is attached a length of high test line 21. The line 21, which may comprise, for example, a 5, or 10, or 15 foot length of 100 pound test nylon, is stored within the inner shaft 12 prior to shooting and is suitably secured to the arrowhead 13, for example, by means of a metal eyelet 22. The nock 17 is also provided with anchoring means 23, such as spring loaded swing arms 24 and 26.

In operation, which is depicted sequentially in FIGS. 1–3, when the arrow 10 is shot and the arrowhead 13 impacts the target, for example, a deer, the outer shaft 11 slides forwardly an inch or so over the inner shaft 12, causing the rearward end of the inner shaft to drive the nock 17 from its position within the outer shaft. The nock 17 then falls to the ground pulling the line 21 along with it. Simultaneously, the swing arms 24 and 26 of the spring loaded anchoring means 23 are forced open facilitating the nock's becoming tangled in the brush, around a tree, around the legs of the game, or the like, when the wounded game begins to run. As the wounded game continues to run, the entire length of line 21 is withdrawn from within the inner shaft 12 until it becomes taut. Still further running by the game causes the taut line to pull the arrowhead back through the game such that the rear cutting edges 15, as well as the side cutting edges 14, pierce the game, thereby causing massive hemorrhaging, a more rapid kill and an easily detectable blood trail. In this latter regard, it will be appreciated that the game will undergo massive hemorrhaging both when the arrowhead has been pulled out of an embedded wound or when the arrowhead is pulled back completely through the game's body, as is the case when the arrow impacts the game's body with sufficient force to pass completely through the game.

Although this invention has been described with a certain degree of particularity, it is to be understood that the modifications given are by way of example only and that further modifications may be made without departing from the spirit of this invention.

I claim:

1. A hunting arrow, which comprises:

a first hollow shaft having a forward end and and a rearward end;

an arrowhead mounted to said forward end of said first hollow shaft;

a second hollow shaft having a forward end and a rearward end, said second hollow shaft being slidably fitted over said first hollow shaft and being shorter than said first shaft;

a nock detachably fitted within said rearward end of said second hollow shaft;

a length of high strength line disposed within said first hollow shaft;

means for securing one end of said line to said nock; and means for securing the other end of said line to said arrowhead, whereby, upon impact with a target, said second shaft will slide forwardly over said first shaft causing said rearward end of said first shaft to drive against and detach said nock from within said second shaft.

2. The arrow of claim 1, further comprising anchoring means secured to said nock.

3. The arrow of claim 2, wherein said anchoring means comprises spring loaded swing arms adapted to be disposed within said first shaft when said nock is fitted in position within said second shaft, and adapted to swing open when said nock is detached from said second shaft.

4. The arrow of claim 3, wherein said arrowhead is provided with side cutting edges and rear cutting edges.

5. The arrow of claim 1 further comprising flight guiding feathers.

6. The arrow of claim 1, wherein said arrowhead is provided with side cutting edges and rear cutting edges.

7. The arrow of claim 1, wherein a positive force is required to slide said second shaft forwardly over said first shaft.

8. A hunting arrow, which comprises:

a first hollow shaft of predetermined length;

a second hollow shaft of predetermined length, said second hollow shaft being shorter than said first hollow shaft and being mounted for frictional sliding movement over said first hollow shaft;

an arrowhead mounted to a first end of said first hollow shaft;

a nock frictionally fitted within the end of said second hollow shaft remote from said arrowhead, said nock being removable from said second shaft by dislodging contact with the second end of said first shaft when said second shaft is slid over said first shaft in the direction of said arrowhead; and a length of high strength line secured at one end thereof to said nock and at the other end thereto to said arrowhead.

9. The arrow of claim 8, further comprising anchoring means secured to said nock.

10. The arrow of claim 9, wherein said anchoring means comprises spring loaded swing arms adapted to be disposed within said first shaft when said nock is fitted in position within said second shaft, and adapted to swing open when said nock is detached from said second shaft.

* * * * *